US006452566B1

(12) United States Patent
Altschul

(10) Patent No.: US 6,452,566 B1
(45) Date of Patent: Sep. 17, 2002

(54) ANTENNA CONSTRUCTION FOR WIRELESS TELEPHONIC COMMUNICATIONS SYSTEMS AND METHOD

(75) Inventor: Randice-Lisa Altschul, Cliffside Park, NJ (US)

(73) Assignee: Dieceland Technologies Corp., Cliffside Park, NJ (US)

( * ) Notice: Subject to any disclaimer, the term of this patent is extended or adjusted under 35 U.S.C. 154(b) by 0 days.

(21) Appl. No.: 09/996,305

(22) Filed: Nov. 21, 2001

(51) Int. Cl.[7] ..... H01Q 1/12

(52) U.S. Cl. ..... 343/890; 343/700 MS; 343/878

(58) Field of Search ..... 343/700 MS, 878, 343/890, 891, 893

(56) References Cited

U.S. PATENT DOCUMENTS

| | | | | |
|---|---|---|---|---|
| D369,785 S | | 5/1996 | Cote | D13/184 |
| 5,581,958 A | | 12/1996 | Cote | 52/40 |
| 5,619,217 A | | 4/1997 | Mailandt et al. | 343/872 |
| 5,673,886 A | * | 10/1997 | Negishi | 248/218.4 |
| D407,707 S | | 4/1999 | Jones | |
| 5,954,305 A | | 9/1999 | Calabro | 248/219.4 |
| 5,965,848 A | * | 10/1999 | Altschul et al. | 174/254 |
| 6,222,503 B1 | * | 4/2001 | Gietema et al. | 343/890 |
| 6,326,920 B1 | * | 12/2001 | Barnett et al. | 343/700 MS |

FOREIGN PATENT DOCUMENTS

| | | | | |
|---|---|---|---|---|
| JP | 02000196351 A | * | 7/2000 | H01Q/21/24 |

* cited by examiner

*Primary Examiner*—Don Wong
*Assistant Examiner*—Shih-Chao Chen
(74) *Attorney, Agent, or Firm*—Arthur Jacob

(57) ABSTRACT

An antenna construction for a wireless telephonic communications system has a body member including a sleeve-like wall of dielectric material and integral antenna elements. The sleeve-like wall is fitted over a projecting element of an existing structure, such as the top portion of an existing utility pole, to present an aesthetically unobtrusive arrangement on the existing structure. In the preferred construction, the dielectric material is provided in the form of an elongate ribbon-like substrate which, together with the integral antenna elements, is wrapped upon itself to establish the sleeve-like wall.

10 Claims, 3 Drawing Sheets

ANTENNA CONSTRUCTION FOR WIRELESS TELEPHONIC COMMUNICATIONS SYSTEMS AND METHOD

The present invention relates generally to wireless telephonic communications systems and pertains, more specifically, to antenna constructions and the installation of such antenna constructions in wireless telephonic communications systems and, in particular, cellular telephonic communication systems.

Antennas for wireless telephonic communications systems and, in particular, antennas for cellular systems, currently are proliferating and the proliferation is meeting with local resistance as more and more neighborhoods complain about the intrusion of unsightly antenna structures. Government agencies and communications providers continually must deal with local requests for removal of existing antennas and related structures, and with petitions to prevent the construction of such installations altogether. Attempts to hide or disguise cellular antenna installations thus far have met with little success. As a result, either cellular service or local aesthetics is compromised.

The present invention alleviates the problems of local aesthetics while, at the same time, providing better wireless telephonic communications service. As such, the present invention attains several objects and advantages, some of which are summarized as follows: Enables the placement of antennas for wireless telephonic communications systems on existing structures in an unobtrusive and effective manner; establishes a more effective antenna arrangement for cellular telephonic communications systems; enables a more aesthetically pleasing antenna arrangement for cellular telephonic communications systems; provides a relatively inexpensive antenna construction for use in connection with wireless telephonic communications systems, with greater effectiveness and less visual intrusion; provides an antenna construction which is inherently more resistant to weather and other environmental elements encountered in the field, enabling exemplary service over an extended service life.

The above objects and advantages, as well as further objects and advantages, are attained by the present invention which may be described briefly as an antenna construction for use in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the antenna construction comprising: a body member having a sleeve-like wall including a substrate of dielectric material, antenna elements integral with the substrate, and a receptacle portion for receiving the projecting element within the sleeve-like wall such that upon reception of the projecting element within the receptacle portion, the sleeve-like wall is juxtaposed with the projecting element essentially as a visual extension of the existing structure, with the assembled body member and projecting element presenting an aesthetically unobtrusive arrangement on the existing structure.

In addition, the present invention provides a method of making an antenna construction for use in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the method comprising: forming antenna elements integral with an elongate substrate of dielectric material; wrapping the substrate upon itself to establish a body member having a sleeve-like wall including a receptacle portion for receiving the projecting element within the sleeve-like wall such that upon reception of the projecting element within the receptacle portion, the sleeve-like wall is juxtaposed with the projecting element essentially as a visual extension of the existing structure, with the assembled body member and projecting element presenting an aesthetically unobtrusive arrangement on the existing structure.

Further, the present invention includes a method of providing an antenna construction in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the method comprising the steps of: forming a body member having a sleeve-like wall including a substrate of dielectric material, antenna elements integral with the substrate, and a receptacle portion for receiving the projecting element within the sleeve-like wall; and placing the sleeve-like wall over the projecting element for reception of the projecting element within the receptacle portion such that the sleeve-like wall is juxtaposed with the projecting element essentially as a visual extension of the existing structure, with the assembled body member and projecting element presenting an aesthetically unobtrusive arrangement on the existing structure.

The invention will be understood more fully, while still further objects and advantages will become apparent, in the following detailed description of a preferred embodiment of the invention illustrated in the accompanying drawing, in which.

Figure 1:
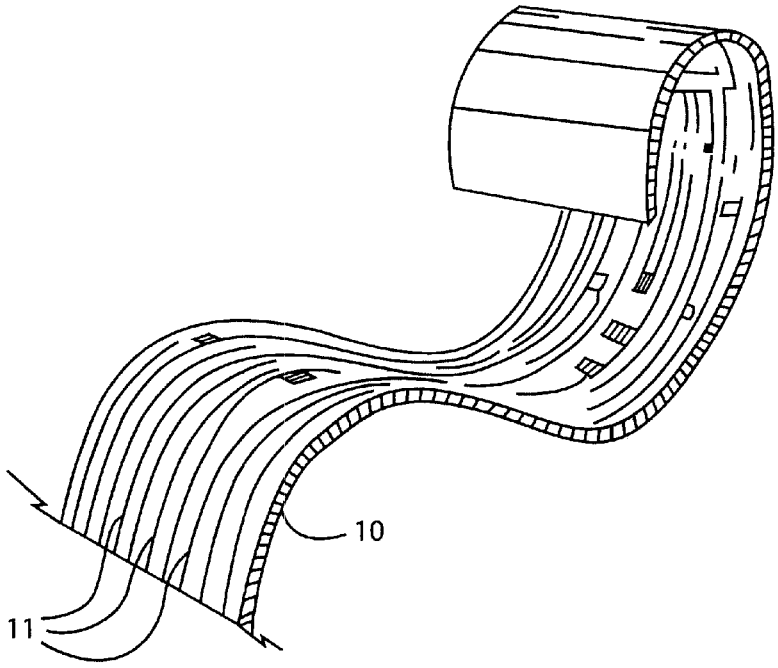
FIG. 1 is a diagrammatic fragmentary pictorial view illustrating the making of an antenna construction in accordance with the present invention.
Figure 2:
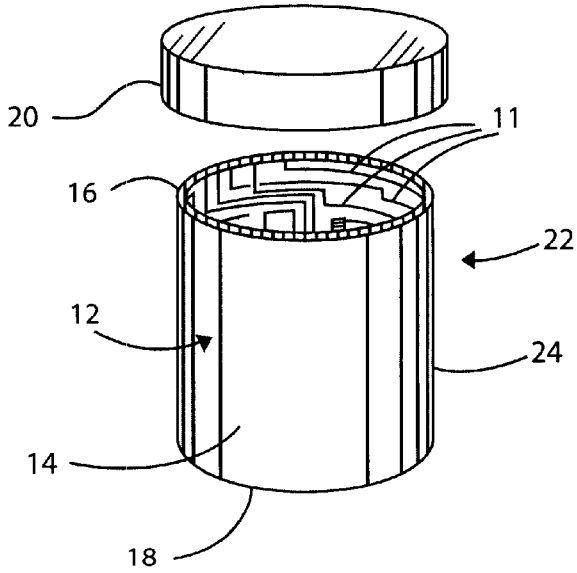
FIG. 2 is an exploded pictorial view of the antenna construction.

Referring now to the drawing, and especially to FIG. 1 thereof, an elongate, ribbon-like member in the form of a substrate of dielectric material carries a plurality of conductive antenna elements 11, formed on the substrate 10 in much the same manner as disclosed in U.S. Pat. No. 5,965,848, the substance of which patent is incorporated herein by reference thereto. Substrate 10 then is wrapped upon itself to establish a body member 12, with integral antenna elements 11, as seen in FIG. 2, in accordance with a method similar to that disclosed in the aforesaid patent. Body member 12 includes an essentially tubular, sleeve-like wall 14 having a generally cylindrical configuration and extending between a first, or upper end 16 and a second, or lower end 18, the cylindrical configuration preferably being in the form of a right cylinder, for purposes to be described below. An end cap 20 is to be joined to the upper end 16 to close the sleeve-like wall 14 at the upper end 16 and establish an antenna construction 22 having a thimble-like structure 24.

Figure 3:
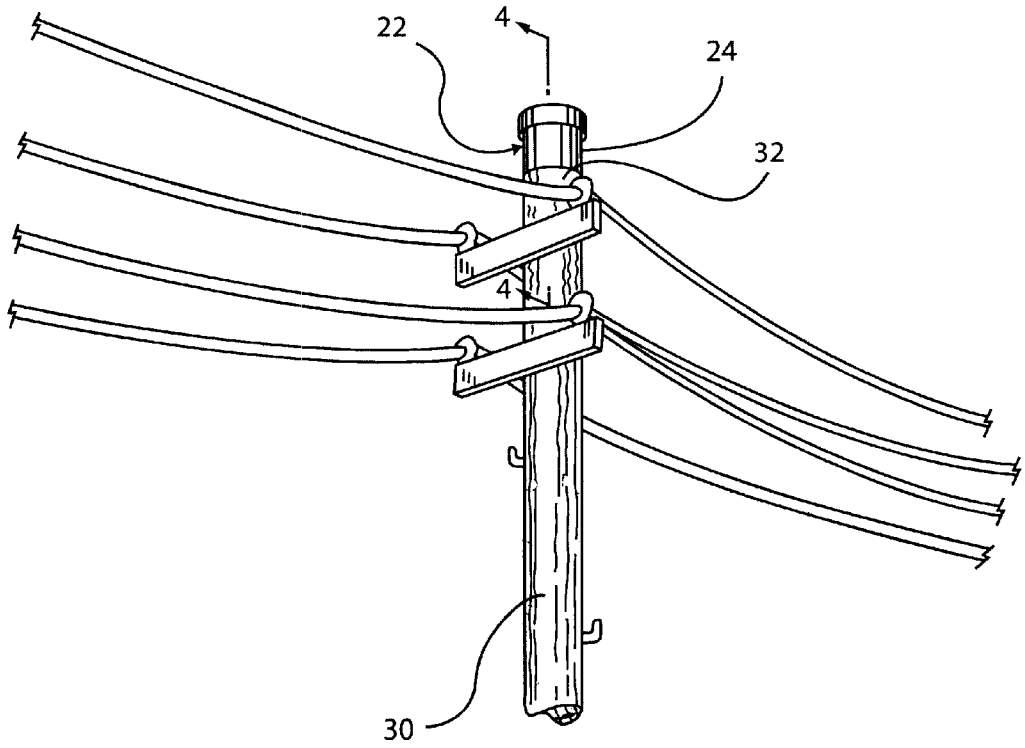
FIG. 3 is a pictorial view showing an installation utilizing an antenna construction of the present invention.
Figure 4:
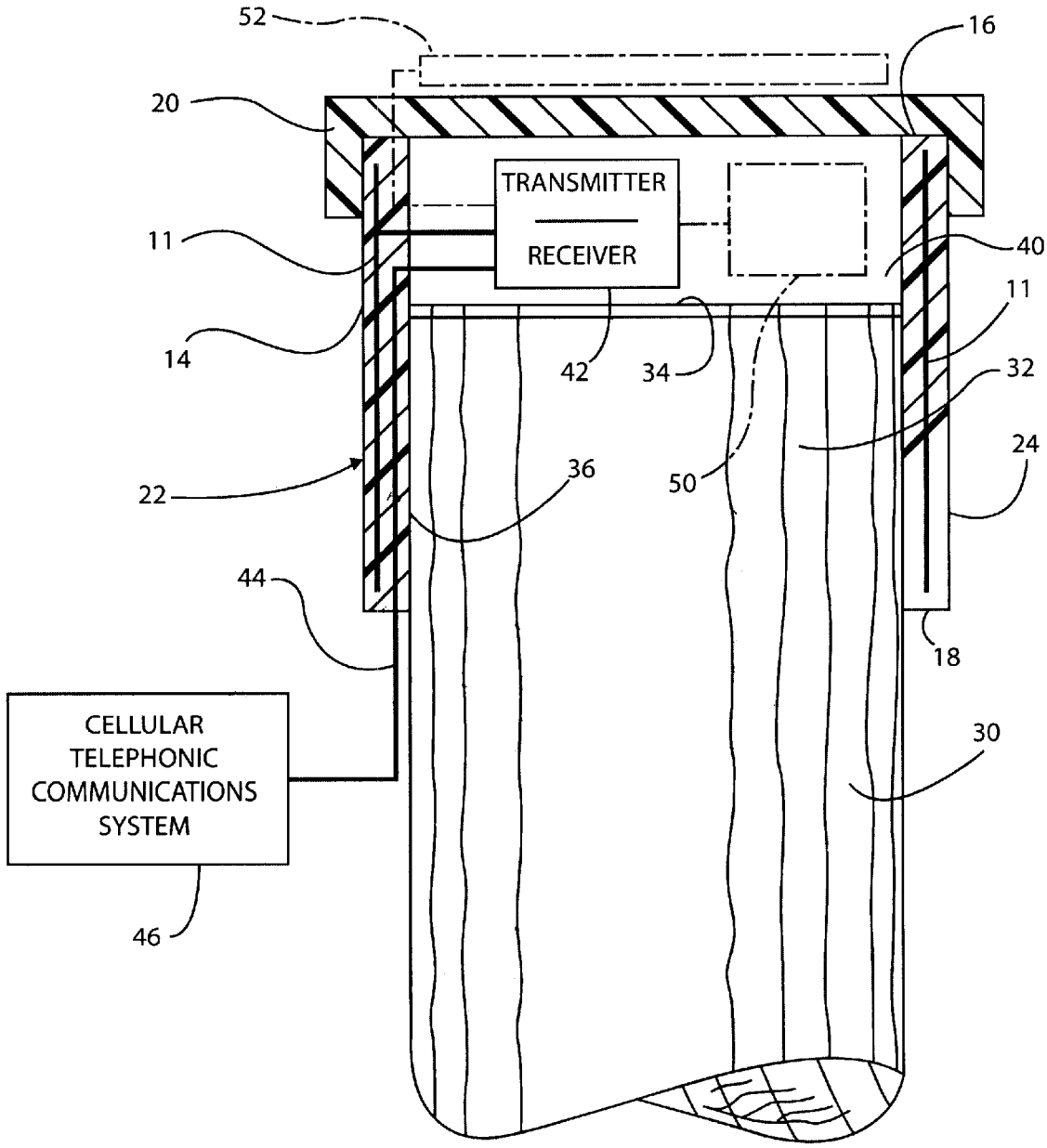
FIG. 4 is a partially diagrammatic, enlarged fragmentary cross-sectional view taken along line 4—4 of FIG. 3.

Turning now to FIGS. 3 and 4, one of a plurality of ubiquitous conventional utility poles is shown at 30 and is seen to have an upwardly projecting element in the form of a cylindrical projection 32 adjacent the top 34 of the pole 30.

The wall 14 of antenna construction 22 includes a receptacle portion 36 adjacent the lower end 18 and, in the illustrated embodiment, the receptacle portion 36 is cylindrical and essentially complementary to the cylindrical projection 32 so that the thimble-like structure 24 is fitted readily over the projection 32 to mechanically couple the antenna construction 22 with the utility pole 30. Thus, the sleeve-like wall 14 is juxtaposed with the projection 32 so as to appear essentially as a visual extension of the utility pole 30, and the antenna construction 22, as assembled with the utility pole 30, presents an aesthetically unobtrusive arrangement at the top 34 of the pole 30.

As seen in FIG. 4, the end cap 20 is spaced from the top 34 of the pole 30 to establish a chamber 40 within the antenna construction 22 and one or more components of a cellular telephonic communications system may be housed within the chamber 40. For example, a component is illustrated in the form of a transmitter/receiver 42 placed within the chamber 40 and connected by a trunk line 44 to a cellular telephonic communications system 46. Alternately, or in addition to any component housed in the chamber 40, components of the cellular telephonic communications system 46 may be formed directly on the substrate 10, in the manner disclosed in the aforesaid U.S. Pat. No. 5,965,848. Power required to operate the antenna construction 22 and any components thereof, or of the cellular telephonic communications system 46, is available readily at the utility pole 30. Alternate sources of power, such as a battery pack or a solar energy converter, shown in phantom at 50 and 52, respectively, or a combination solar energy charged battery pack (not shown) are easily adapted to the antenna construction 22 and are made available in keeping with the overall aesthetically unobtrusive installation.

The wrapped construction of wall 14 of antenna construction 22 enables the wall 14 to be constructed of a laminated synthetic polymeric material which not only provides an aesthetically unobtrusive and desirable appearance, but which will withstand the elements to which the antenna construction 22 is exposed in the field, thus enabling exemplary performance over a relatively long service life. The unobtrusive nature of the antenna construction 22, together with the relatively inexpensive and simplified construction of antenna construction 22 and the ability to couple the antenna construction 22 readily to existing structures, such as common utility poles 30, enables the placement of a higher density of adjacent antenna constructions 22 within the cellular telephonic communications system 46, allowing the use of clusters of antenna constructions 22 located on a corresponding plurality of utility poles 30 for more effective cellular service, without cluttering neighborhoods with multiple unsightly and obtrusive cellular antennas. The overall construction, as well as the method of making antenna construction 22, allows variations in the configuration of sleeve-like wall 14 for accommodating a variety of existing structures, such as existing poles, towers, masts, steeples and similar structures which provide projecting elements that can be more-or-less capped with an antenna construction 22 configured for a particular existing structure without imposing a visually obtrusive and aesthetically undesirable antenna structure on any particular neighborhood. At the same time, operating performance of the cellular telephonic communications system is improved dramatically by allowing a better concentration and distribution of antennas, unrestrained by aesthetic considerations.

It will be seen that the present invention attains the several objects and advantages summarized above, namely: Enables the placement of antennas for wireless telephonic communications systems on existing structures in an unobtrusive and effective manner; establishes a more effective antenna arrangement for cellular telephonic communications systems; enables a more aesthetically pleasing antenna arrangement for cellular telephonic communications systems; provides a relatively inexpensive antenna construction for use in connection with wireless telephonic communications systems, with greater effectiveness and less visual intrusion; provides an antenna construction which is inherently more resistant to weather and other environmental elements encountered in the field, enabling exemplary service over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. An antenna construction for use in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the antenna construction comprising:

a body member having a sleeve-like wall including a substrate of dielectric material, antenna elements integral with the substrate, and a receptacle portion for receiving the projecting element within the sleeve-like wall such that upon reception of the projecting element within the receptacle portion, the sleeve-like wall is juxtaposed with the projecting element essentially as a visual extension of the existing structure, with the assembled body member and projecting element presenting an aesthetically unobtrusive arrangement on the existing structure.

2. The antenna construction of claim 1 wherein the body member includes a first end and a second end, the receptacle portion being adjacent the second end for coupling the second end of the body member with the projecting element, and the antenna construction includes an end cap for being joined to the first end of the body member to establish a thimble-like structure for fitting over the projecting element.

3. The antenna construction of claim 1 wherein the existing structure is a utility pole having a top end and the projecting element comprises a generally cylindrical top portion of the utility pole adjacent the top end, the body member of the antenna construction having a generally cylindrical configuration for being fitted over the top portion of the utility pole so as to establish an essentially visual extension of the cylindrical top portion of the utility pole.

4. The antenna construction of claim 3 wherein the body member includes an upper end and a lower end, the receptacle portion being adjacent the lower end for coupling the lower end of the body member with the top portion of the utility pole, and the antenna construction includes an end cap for being joined to the upper end of the body member to establish a thimble-like structure for fitting over the top portion of the utility pole.

5. The antenna construction of claim 1 wherein the substrate comprises an elongate ribbon-like member wrapped upon itself to establish the sleeve-like wall.

6. An antenna construction for use in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the antenna construction comprising:

a body member having a sleeve-like wall including a substrate of dielectric material, antenna elements integral with the substrate, and a receptacle portion for receiving the projecting element within the sleeve-like wall such that upon reception of the projecting element within the receptacle portion, the sleeve-like wall is juxtaposed with the projecting element essentially as a visual extension of the existing structure, with the assembled body member and projecting element presenting an aesthetically unobtrusive arrangement on the existing structure; and a chamber within the sleeve-like wall for housing at least a component of the wireless telephonic communications system within the body member.

7. A method of making an antenna construction for use in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the method comprising:

forming antenna elements integral with an elongate substrate of dielectric material;

wrapping the substrate upon itself to establish a body member having a sleeve-like wall including a receptacle portion for receiving the projecting element within the sleeve-like wall such that upon reception of the projecting element within the receptacle portion, the sleeve-like wall is juxtaposed with the projecting element essentially as a visual extension of the existing structure, with the assembled body member and projecting element presenting an aesthetically unobtrusive arrangement on the existing structure.

8. The method of claim 7 wherein the body member includes a first end and a second end, the receptacle portion being adjacent the second end for coupling the second end of the body member with the projecting element, and the method includes joining an end cap to the first end of the body member to establish a thimble-like structure for fitting over the projecting element.

9. A method of providing an antenna construction in a wireless telephonic communications system wherein a plurality of such antenna constructions are mounted upon a corresponding plurality of existing structures by assembling each antenna construction with a projecting element of a corresponding existing structure in an aesthetically unobtrusive arrangement on the corresponding existing structure, the method comprising the steps of:

forming a body member having a sleeve-like wall including a substrate of dielectric material, antenna elements integral with the substrate, and a receptacle portion for receiving the projecting element within the sleeve-like wall; and placing the sleeve-like wall over the projecting element for reception of the projecting element within the receptacle portion such that the sleeve-like wall is juxtaposed with the projecting element essentially as a visual extension of the existing structure, with the assembled body member and projecting element presenting an aesthetically unobtrusive arrangement on the existing structure.

10. The method of claim 9 wherein the existing structure is a utility pole having a top end and the projecting element comprises a generally cylindrical top portion of the utility pole adjacent the top end, and the body member of the antenna construction has a generally cylindrical configuration, and wherein the step of placing the sleeve-like wall over the projecting element comprises fitting the generally cylindrical configuration of the antenna construction over the top portion of the utility pole so as to establish an essentially visual extension of the cylindrical top portion of the utility pole.

* * * * *